United States Patent [19]

Picker

[11] Patent Number: 4,685,391

[45] Date of Patent: Aug. 11, 1987

[54] REMOTELY CONTROLLED MULTISHAPED CONTAINER COMPACTING PRESS

[75] Inventor: Franck Picker, Nashville, Tenn.

[73] Assignee: The Scientific Ecology Group, Inc., Oak Ridge, Tenn.

[21] Appl. No.: 819,270

[22] Filed: Jan. 16, 1986

[51] Int. Cl.[4] ..... B30B 9/32

[52] U.S. Cl. ..... 100/242; 53/527; 100/246; 100/253; 100/269 R; 100/902

[58] Field of Search ..... 100/902, 295, 240, 242, 100/245, 246, 247, 248, 249, 252, 253, 269 R; 53/527

[56] References Cited

U.S. PATENT DOCUMENTS

| | | | |
|---|---|---|---|
| Re. 29,278 | 6/1977 | Vogel . | |
| 2,358,765 | 9/1944 | Stadlin | 100/246 X |
| 3,384,007 | 5/1968 | Boje et al. . | |
| 3,791,289 | 2/1974 | Lamorte et al. . | |
| 3,802,336 | 4/1974 | Toppins . | |
| 3,911,807 | 10/1975 | Birnbaum | 100/246 X |
| 3,988,978 | 11/1976 | Flick . | |
| 4,127,062 | 11/1978 | Egosi | 100/245 X |
| 4,224,780 | 9/1980 | Rewitzer . | |
| 4,303,412 | 12/1981 | Baikoff . | |
| 4,590,000 | 5/1986 | Baatz | 53/527 X |

FOREIGN PATENT DOCUMENTS

| | | | |
|---|---|---|---|
| 2153275 | 8/1985 | United Kingdom | 100/902 |

*Primary Examiner*—Billy J. Wilhite

*Attorney, Agent, or Firm*—Stevens, Davis Miller & Mosher

[57] ABSTRACT

Disclosed is an apparatus for crushing differently shaped and/or sized containers of waste material without disassembly of the device. A mold, having an inner cavity sized so as to accommodate a larger container, has a sleeve located therein which can be locked to the mold for simultaneous operation. The sleeve has an inner cavity of a shape and size so as to contain the smaller container and also to allow a ram to move through the sleeve cavity and compress the smaller container. The ram also has a structure for locking the sleeve to the ram so as to permit the sleeve ram combination to crush a larger container which has been located in the mold cavity. The locking and unlocking of the mold/sleeve or sleeve/ram as well as the mold movement and ram movement are all remotely controlled so as to permit crushing of various sized and shaped containers without disassembly of the press and the consequent exposure of workers to possible hazardous conditions.

10 Claims, 8 Drawing Figures

REMOTELY CONTROLLED MULTISHAPED CONTAINER COMPACTING PRESS

BACKGROUND OF THE INVENTION

1. Field of the Invention

The present invention relates generally to compacting presses and specifically to compacting presses for compacting materials in different shaped containers.

2. Discussion of the Prior Art

Conventional compacting presses have dedicated tooling, i.e., the mold in which the material is compacted comprises a part of the press itself and is sized and shaped to receive a container. The container, often called an "innerpack", contains the material to be compacted and becomes an integral part of the compacted material or "slug". Such systems are relatively common when disposing of hazardous waste material such as low-level radio-active material, etc. The innerpack system permits a minimal contamination of the press and its surroundings and at the same time insures mechanical integrity of the slug.

Becuase of the dedicated tooling, a given press can handle only one size or shape innerpack at a time. In many instances it is not even possible to change the mold (that portion which defines the outer perimeter of the compacted slug) in order to adapt to a larger or smaller innerpack. Those pressses in which it is possible to change the mold, require disassembly and reassembly of the press to substitute the replacement mold and its associated ram. In the case of a heavy press with possibly contaminated components, this task can be very extensive and expensive when it is necessary to insure a clean environment and protect workers involved in the process.

SUMMARY OF THE INVENTION

It is therefore an object of the present invention to be able to compact materials in a variety of containers without direct worker involvement.

It is a further object of the present invention to be able to compact a larger rectangular container as well as a smaller drum-shaped container without disassembly and reassembly of the press.

It is a still further object of the present invention to provide a compacting press capable of compacting a variety of innerpack configurations by remote control.

The above and other objects are achieved in accordance with the present invention by providing a press capable of compacting at least a larger container and a smaller container without disassembly of the press, said press comprising:

a press bed; a mold means having an inner cavity so as to provide a compaction fit around the largest container to be compacted by said press; sleeve means, receivable in said mold inner cavity, said sleeve means having an inner cavity sized so as to provide a compaction fit with respect to said smaller container; ram means, receivable in said sleeve means inner cavity, for compacting said smaller container; mold locking means for remotely controlled interconnecting of said sleeve means with said mold means; ram locking means for remotely controlled interconnecting of said sleeve means with said ram means; ram power means for moving said ram means between a load position and a crushed position; and mold power means for moving said mold means between a load position and a closed position, said closed position comprising said mold means in contact with said press bed, said ram means comprising a means for crushing said smaller container under the influence of said ram power means when said sleeve means is in a closed position, said ram means and said sleeve means comprising a means for crushing said larger container under the influence of said ram power means when said ram locking means has interconnected said sleeve means with said ram means.

BRIEF DESCRIPTION OF THE DRAWINGS

A more complete appreciation of the invention, and many of the attendant advantages thereof, will be readily apparent as the same becomes better understood by reference to the accompanying drawings, wherein.

DETAILED DESCRIPTION OF PREFERRED EMBODIMENTS

Figure 1:
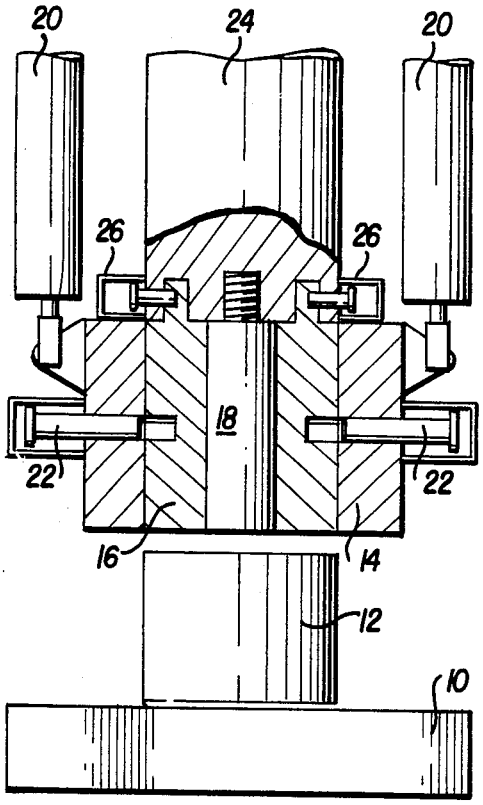
FIG. 1 is a side view partially in section illustrating the present invention in the load position.

Referring now more particularly to the drawings wherein like numerals represent like elements throughout the several views, FIG. 1 illustrates one embodiment of the present invention. A press bed 10 has a large container 12 located thereon. In one embodiment the container is a rectangular innerpack 35 inches wide by 44 inches deep by 48 inches high. The compacting press has three main movable components; mold means 14, sleeve means 16, and ram means 18. Mold means 14 has an inner cavity which permits a compaction fit around large container 12. A compaction fit is defined as a sufficiently large clearance to allow the mold to slide down over container 12 but with a small enough clearance to prevent extrusion of container material between the mold 14 and sleeve 16 during compaction.

Figure 2:
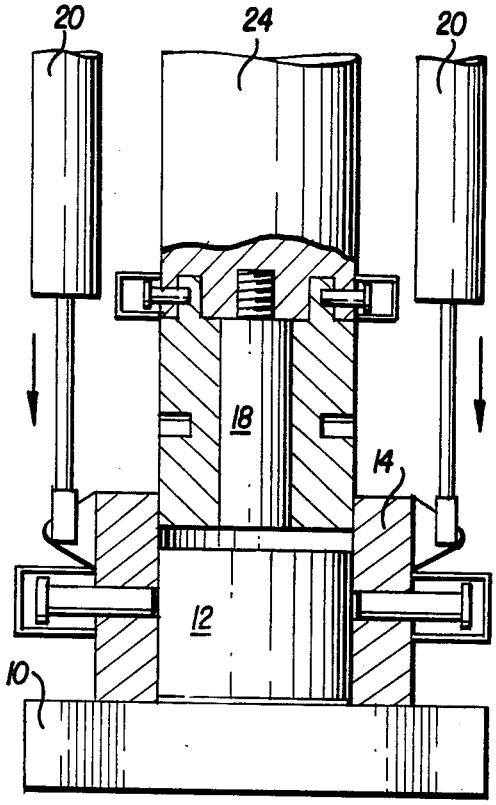
FIG. 2 is a side cross-sectional view of the present invention preparatory to compacting a large container.

The mold position is controlled by a mold power means 20 which in a preferred embodiment may be a pair of hydraulically powered cylinders. These cylinders may be remotely controlled to move the mold between a load position, as shown in FIG. 1, and a closed position, as shown in FIG. 2, where the mold is in contact with the press bed 10. Mounted on the mold are mold locking means 22 which serve to controllably interconnect the mold 14 and sleeve 16. The mold locking means 22 may be pins which are inserted into and withdrawn from the sleeve by the action of hydraulic fluid controlled from a remote controlled hydraulic source 23.

Figure 3:
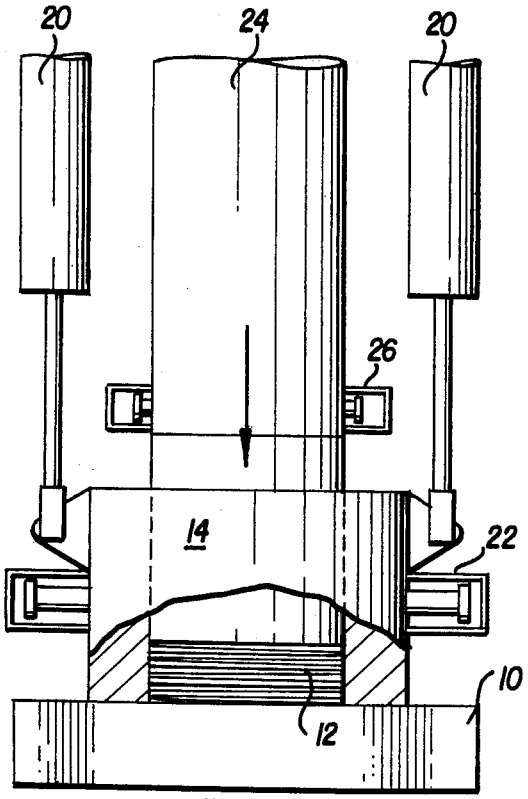
FIG. 3 is a side view partially in section illustrating the compression of the compacting of a large container.
Figure 4:
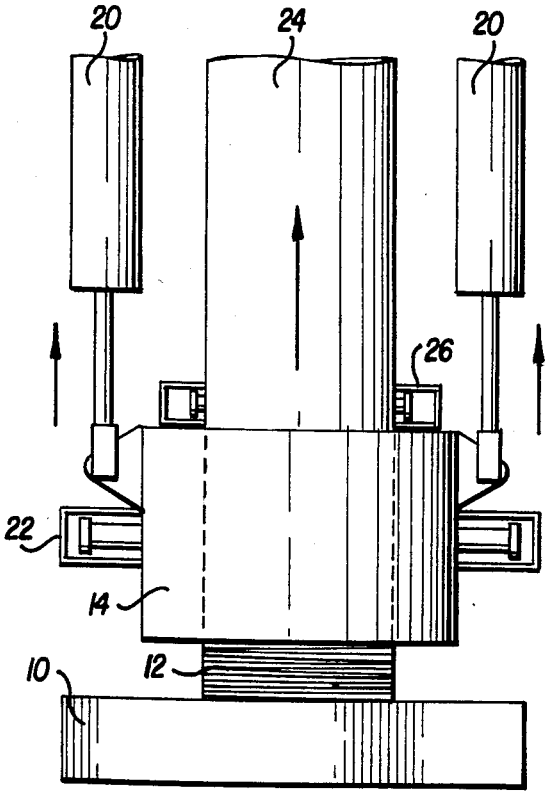
FIG. 4 is a side view of the present invention showing retraction of the mold from the compacted large container.
Figure 7:
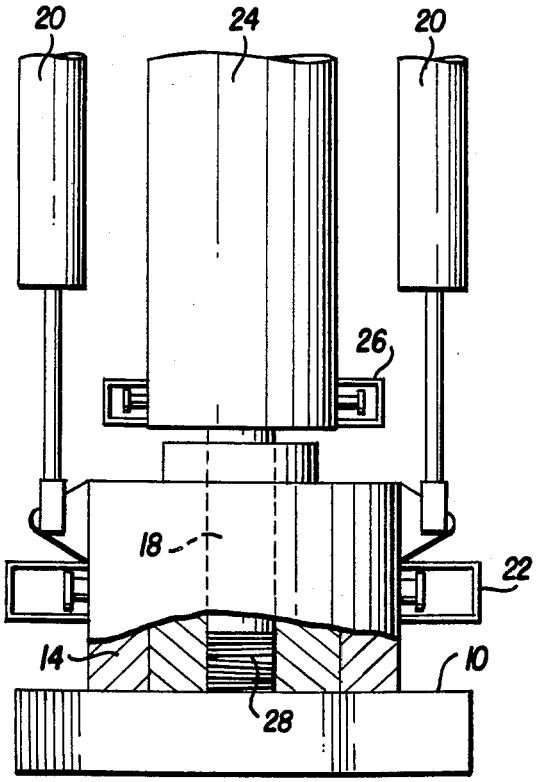
FIG. 7 is a side view partially in section illustrating compaction of a small container.

It can be seen that ram 18 in this embodiment is threadably secured to a ram power means 24 which serves to move the ram between a load position as shown in FIG. 1 and a crushed container position shown in FIGS. 3 and 7. In a preferred embodiment the ram power means 24 includes a hydraulic actuating cylinder (not shown) which is remotely controlled. Mounted on the ram power means 24 are ram locking means 26 which, in a manner similar to the mold locking means, remotely interconnects the ram 18 and sleeve 16. In a preferred embodiment these are also comprised of pins which can be inserted into and withdrawn from the ram 18 under the influence of hydraulic cylnders controlled from a remote location. Thus with the compacting press in the FIG. 1 condition, the sequence of steps for crushing a large container will now be discussed.

Container 12 is positioned directly under sleeve 16 with the mold locking means 22 in the unlocked position and the ram locking means 26 in the locked position. The mold power means 20 is energized as shown in FIG. 2 to move the mold into the closed position wherein it is in contact with the press bed and surrounds large container 12. Once the mold is in position, the ram power means 24 can be energized to move the ram towards its crushed position. Because the ram locking means 26 is in the locked position, the ram 18 and sleeve 16 move together and form a crushing ram equal to the size and shape of large container 12. Movement of the ram and sleeve under the influence of ram power means 24 continues until the ram reaches the desired crushed position. This position may be determined by an actual physical dimension or a predetermined hydraulic pressure in the hydraulic supply powering the ram power means.

By virtue of the crushing and compacting action of ram 18 and sleeve 16, the walls of the large container will have buckled outward and inward forming an integral container for the crushed material contained therein. However, the buckling of the walls also serves to provide a high friction or interference fit between the compressed large container 12 and the inner cavity of mold 14 as shown in FIG. 3. Accordingly, to withdraw the mold, sleeve and ram to their original load position, the mold power means 20 is first energized in its opposite direction so as to pull mold 14 upwardly away from crushed large container 12. Ram 18 and sleeve 16 remain in their crushed position preventing the large container 12 from being lifted upwardly as mold 14 is retracted. Once the lower portion of mold 14 is flush with the lower crusing surface of ram 18 and sleeve 16, it will be free of any further interference fit with large container 12 and the ram power means can be energized to withdraw ram 18 and sleeve 16 to the load position shown in FIG. 1.

Figure 5:
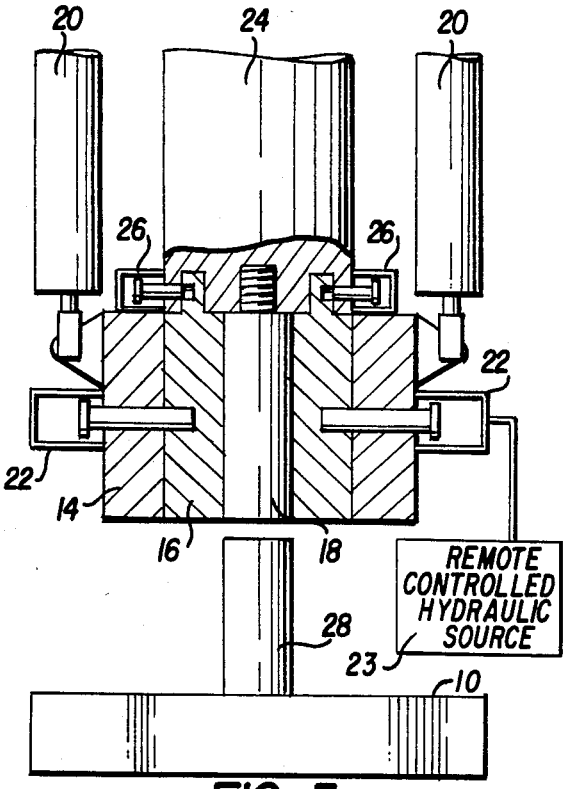
FIG. 5 is a side view partially in section of the present invention in the load position for a smaller container.
Figure 6:
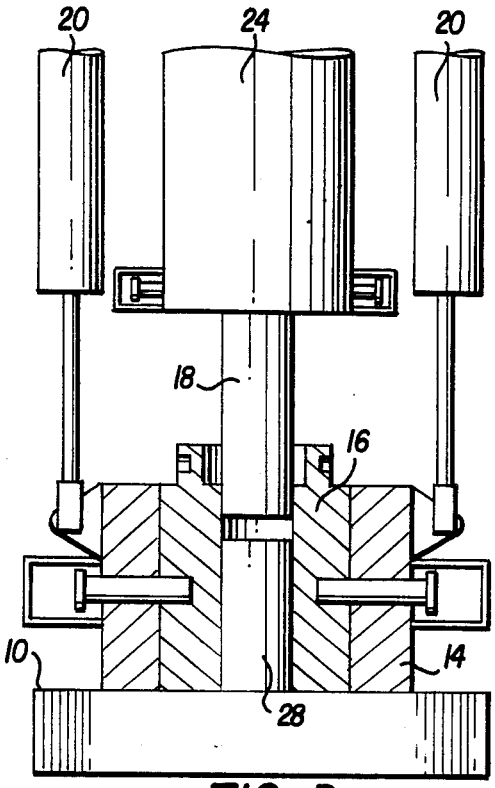
FIG. 6 is a side view partially in section of the mold and sleeve of the present invention in the closed position.

This sequence of steps can be repeated as many times as there are large containers 12 which need to be compacted. However if a smaller container 28 is to be crushed, the sequence of steps is slightly different. The mold locking means 22 is energized so as to lock mold 14 and sleeve 16 together. The ram locking means 26 is energized so as to unlock the sleeve 16 from ram 18 as shown in FIG. 5. It can be seen that sleeve 16 has an inner cavity which will form a compaction fit around smaller container 28. The mold power means is energized to move the mold to its closed position in contact with press bed 10. Because the mold locking means has locked sleeve 16 to mold 14 the sleeve also moves down and around smaller container 28 as shown in FIG. 6.

Figure 8:
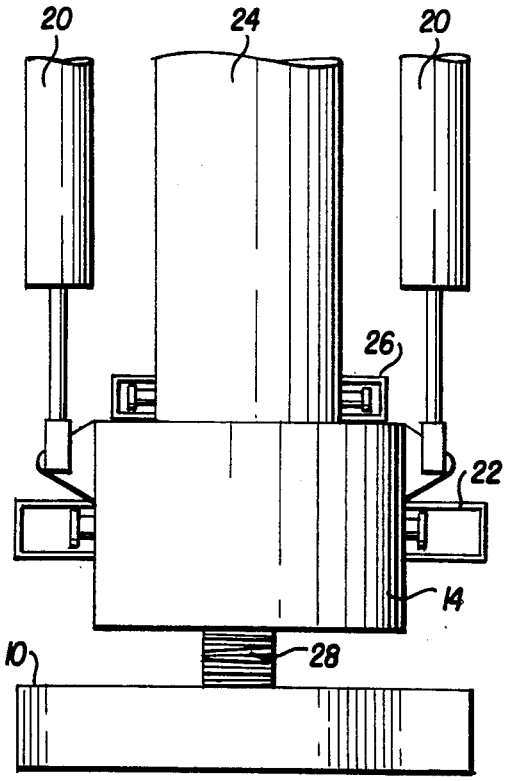
FIG. 8 is a side view illustrating retraction of the mold and sleeve from a compacted small container.

Once the mold and sleeve are in their closed position, ram power means 24 is energized and ram 18 begins moving towards its crushed position. Again this position can be determined in any desired manner, e.g., by a specific crush dimension that the slug must have or a given hydraulic pressure indicative of a certain crush density, etc. Once small container 28 has been crushed to its desired crushed position the mold power means 20 is energized to withdraw the mold 14 and sleeve 16 combination with the ram 18 being held in its crushed position. This serves to maintain crushed smaller container 28 in position on the press bed while the mold and sleeve combination are being withdrawn. Once the bottom surface of mold 14 and sleeve 16 are flush with the bottom surface of ram 18 as shown in FIG. 8 the ram power means 24 can also be energized so as to return to the "load" position shown in FIG. 5.

Thus in accordance with the above sequence of events, at least two differently configured containers can be crushed without the necessity for any assembly or disassembly of the press itself. This serves not only to expedite container throughput increasing the number of containers per hour which can be crushed, but also serves to protect workers by avoiding the necessity for workers to enter a possibly contaminated area and handle potentially contaminated structures changing from one mold ram combination to another mold ram combination.

In view of the above disclosure, if it was desirable to be able to crush the rectangular innerpack, a 55 gallon drum and a 52 gallon drum, it can be seen that an additional sleeve could be easily added along with separate locking means which would controllable lock the sleeve into movement with mold 14 or into movement with ram 18. In this situation, the mold would have an inner cavity equal to a compaction fit around the outer dimensions of the largest container as in the FIG. 1 embodiment, the first sleeve would have outer dimensions fitting in the mold cavity with a cavity having inner dimensions providing a compaction fit around the intermediate sized container (55 gallon drum) and an inner sleeve with outer dimensions fitting within the first sleeve's cavity and an inner dimensions forming a compaction fit around the smallest container (the 52 gallon drum). The ram 18 would be sized to crush the smallest container but could be controllably interlocked with either the inner sleeve or the inner sleeve combined with the outer sleeve for crushing the intermediate or large sized containers, respectively. Thus, depending upon the specific container shape and size, the present invention could be configured or modified to handle three or more different sized containers.

Although hydraulically actuated locking means are contemplated, it is also envisioned that electromechanical devices such as solenoid operated levers could be utilized. Furthermore electric motors driving threaded shafts could also be used to lock and unlock the mold with the sleeve or the ram with the sleeve in the present invention. In order to develop most conveniently the crushing pressure needed, it is envisioned that ram power means 24 would be a hydraulic power cylinder supplied with sufficient high pressure hydraulic fluid to move throughout its desired range of operation. However any other form of high pressure, short stroke actuation could be used as long as it provides the desired crushing power. For convenience sake, the mold power means 20 is alos a hydraulic cylinder although a great amount of pressure is not need to raise and lower the mold or the mold and sleeve combination. There may be other structures which are desirable for locating the containers precisely under the mold and sleeve to ensure that container is not damaged as the mold and/or sleeve is lowered over the container in the initial step.

In view of the above disclosure, many modifications and variations on this variable shape compacting press will become obvious to those of ordinary skill in the art. Therefore, the present invention is not limited by the above disclosure, but is only limited by the scope of the claims attached hereto.

The embodiments of the invention in which an exclusive property or privilege is claimed are defined as follows:

1. A press for compacting waste materials in different sized and/or shaped containers including a larger container and a smaller container without disassembly of said compacting press, said press comprising:

a press bed;

mold means, having an inner cavity, for providing a compaction fit around said larger container;

sleeve means, receivable in said mold means inner cavity and having a said sleeve means inner cavity, for providing a compaction fit around said smaller container;

ram means, receivable in said sleeve means inner cavity, for compacting said larger and smaller containers;

mold locking means for interconnecting of said sleeve means with said mold means;

ram locking means for interconnecting of said sleeve means with said ram means;

ram power means for moving said ram means between a load position and a crushed position; and mold power means for moving said mold means between a load position and a closed position, said closed position comprising said mold means in contact with said press bed, said ram means comprising a means for crushing said smaller container under the influence of said ram power means when said sleeve means is in said closed position, said ram means and said sleeve means together comprising a means for crushing said larger container under the influence of said ram power means when said ram locking means has interconnected said sleeve means with said ram means.

2. A press in accordance with claim 1, wherein said press bed includes a planar surface and said mold means, sleeve means and ram means are all movable in a direction perpendicular to said planar surface.

3. A press in accordance with claim 1, wherein said ram power means comprises a hydraulic cylinder responsive to a remotely controlled source of high pressure hydraulic fluid.

4. A press in accordance with claim 1, wherein said mold power means comprises at least one hydraulic cylinder responsive to a remotely controlled source of high pressure hydraulic fluid.

5. A press in accordance with claim 1, wherein said mold locking means comprises a pin reciprocally mounted for movement between a locked and an unlocked position and means for controllably moving said pin between said positions.

6. A press in accordance with claim 1, wherein said ram locking means comprises a pin reciprocally mounted for movement between a locked and an unlocked position and means for controllably moving said pin between said positions.

7. A press in accordance with claim 5, wherein said means for moving said pin comprises a hydraulic cylinder responsive to a remotely controlled source of high pressure hydraulic fluid.

8. A press in accordance with claim 6, wherein said means for moving said pin comprises a hydraulic cylinder responsive to a remotely controlled source of high pressure hydraulic fluid.

9. A press for compacting waste materials in different sized and/or shaped containers including a larger container and at least one smaller container without disassembly of said compacting press, said press comprising:

a press bed;

mold means having an inner cavity so as to provide a compaction fit around said larger container;

at least one sleeve means, movable within said mold inner cavity, said at least one sleeve means having an inner cavity for providing a compaction fit around said at least one smaller container;

ram means, receivable in said sleeve means inner cavity, for compacting said larger and at least one smaller containers;

mold locking means for interconnecting of said at least one sleeve means with said mold means;

ram locking means for interconnecting said at least one sleeve means with ram means;

ram power means for moving said ram means between a load position and a crushed position; and mold power means for moving said mold means between a load position and a closed position, said closed position comprising said mold means in contact with said press bed, said ram means comprising a means for crushing said at least one smaller container under the influence of said ram power means when said at least one sleeve means is in said closed position, said ram means and said at least one sleeve means together comprising a means for crushing said larger container under the influence of said ram power means when said ram locking means has interconnected said at least one sleeve means with said ram means.

10. A press for compacitng waste materials in different sized and/or shaped containers including a larger container and a smaller container without disassembly of said compacting press, said press comprising:

a press bed having a relatively flat horizontal surface;

mold means, having an inner cavity, for providing a compaction fit around said larger container, said mold means movable in a vertical direction;

sleeve means, receivable in said mold means inner cavity, said sleeve mans having an inner cavity, for providing a compaction fit around said smaller container, said sleeve means movable in a vertical direction;

ram means, receivable in said sleeve means inner cavity, for compacting at least said smaller container, said ram means movable in a vertical direction;

mold locking means for interconnecting of said sleeve means with said mold means, said mold locking means comprising a mold locking pin reciprocally mounted for movement between a locked and an unlocked position and a hydraulic cylinder responsive to a remotely controlled source of high pressure hydraulic fluid;

ram locking means for interconnecting of said sleeve means with said ram means, said ram locking means comprising a ram locking pin reciprocally mounted for movement between a locked and an unlocked position and a hydraulic cylinder responsive to a remotely controlled source of high pressure hydraulic fluid;

ram power means for moving said ram means between a load position and a crushed position, said ram power means comprising a hydraulic cylinder responsive to a remotely controlled source of high pressure hydraulic fluid; and mold power means for moving said mold means between a load position and a closed position, said mold power means comprising at least one hydraulic cylinder responsive to a remotely controlled source of high pressure hydraulic fluid, said closed position comprising said mold means in contact with said press bed horizontal surface, said ram means comprising a means for crushing said smaller container under the influence of said ram powe means when said sleeve means is in said closed position, said ram means and said sleeve means together comprising a means for crushing said larger contianer under the influence of said ram power means when said ram locking means has interconnected said sleeve means with said ram means.

* * * * *